US006338425B1

(12) United States Patent
Berge et al.

(10) Patent No.: US 6,338,425 B1
(45) Date of Patent: Jan. 15, 2002

(54) DISPENSING CLOSURE

(75) Inventors: Gary Berge, Crystal Lake; Thomas C. Stoneberg, Buffalo Grove, both of IL (US)

(73) Assignee: Courtesy Corporation, Buffalo Grove, IL (US)

( * ) Notice: Subject to any disclaimer, the term of this patent is extended or adjusted under 35 U.S.C. 154(b) by 0 days.

(21) Appl. No.: 09/680,352

(22) Filed: Oct. 5, 2000

(51) Int. Cl.[7] ..... B67D 3/00

(52) U.S. Cl. ..... 222/521; 222/153.06; 222/182; 222/525; 220/256; 220/266

(58) Field of Search ..... 222/182, 153.06, 222/519, 520, 521, 522, 523, 524, 525, 542; 220/256, 257, 566, 276; 215/250, 253, 258

(56) References Cited

U.S. PATENT DOCUMENTS

| | | | | | |
|---|---|---|---|---|---|
| 3,896,974 | A | * | 7/1975 | McIntosh | 222/182 |
| 4,946,080 | A | * | 8/1990 | Vesborg | 222/500 |
| 4,967,941 | A | | 11/1990 | Beck | |
| 5,148,931 | A | * | 9/1992 | Minh | 215/220 |
| 5,328,063 | A | | 7/1994 | Bece et al. | |
| 5,456,374 | A | * | 10/1995 | Beck | 215/251 |
| 5,472,120 | A | | 12/1995 | Stebick et al. | |
| 5,662,247 | A | * | 9/1997 | Rapchak et al. | 222/153.07 |
| 5,711,443 | A | * | 1/1998 | Bennett | 215/256 |
| 5,743,444 | A | * | 4/1998 | Beck et al. | 222/521 |
| 5,810,185 | A | | 9/1998 | Groesbeck | |
| 5,813,575 | A | * | 9/1998 | Glynn et al. | 222/182 |
| 5,829,611 | A | | 11/1998 | Beck | |
| 5,975,369 | A | | 11/1999 | Yurkewicz et al. | |
| 6,024,256 | A | * | 2/2000 | Beck et al. | 222/153.06 |
| 6,050,436 | A | * | 4/2000 | Bennett et al. | 215/256 |
| 6,050,452 | A | | 4/2000 | Pradinas | |
| 6,092,692 | A | * | 7/2000 | Riskin | 222/23 |
| 6,135,329 | A | * | 10/2000 | Stoneberg et al. | 222/521 |
| D438,114 | S | * | 2/2001 | Stonberg | D9/449 |
| 6,213,351 | B1 | * | 4/2001 | Stoneberg et al. | 222/153.14 |

FOREIGN PATENT DOCUMENTS

| | | |
|---|---|---|
| FR | 324547 | * 11/1957 |
| GB | 943452 | * 12/1963 |

* cited by examiner

*Primary Examiner*—Kevin Shaver
*Assistant Examiner*—Frederick Nicolas
(74) *Attorney, Agent, or Firm*—Silverman, Cass & Singer, Ltd.

(57) ABSTRACT

A dispensing closure for a product container including a base positioned on the container and a cap operable on the base between a closed and an open position. The base includes an upstanding plug engageable within an aperture formed in a top platform of the cap to seal the aperture when the cap is moved to closed position on the base. An annular generally U-shaped sealing flange is formed on the aperture and depends below the top platform of the cap. The flange moves into compression engagement with the plug when the cap is in its closed position so as to seal the contents of the container and prevent product and/or carbonated gas leakage therefrom until the cap is moved to open position.

Also disclosed is an overcap positioned over the cap. The internal configuration of the overcap is in substantial conformity with the external configuration of the cap so that the cap can be moved to its opened and/or closed positions by movement of the overcap and without touching the external surface of the cap.

18 Claims, 7 Drawing Sheets

DISPENSING CLOSURE

BACKGROUND OF THE INVENTION

1. Field of the Invention

This invention relates generally to dispensing closures for containers, and more particularly, to such closures which include a self-sealing spout, and also which may include a control member or overcap for operation of the spout.

2. Description of the Prior Art

Twist top and pull/push closures for containers are known in which a cap or spout with a central aperture cooperates with an upstanding post formed on a base to open or close the closure. The base is affixed to the mouth of a product container, such as a water bottle, and when the cap is moved, such as by twisting or pulling relative to the base, the post on the base is withdrawn from engagement with the aperture in the cap to permit product, such as water, in the container to be dispensed by passing through the aperture. After dispensing of the product is completed, the cap is returned to its closed position by reverse-twisting or pushing on the cap to re-engage the post in the aperture and thereby close the closure and prevent product from being dispensed from the container.

Examples of twist top and pull/push closures of the type referred to above are shown in the following U.S. patents which are owned by a wholly-owned subsidiary of the assignee of the present application: U.S. Pat. No. 5,328,063 issued Jul. 12, 1994 entitled "Venting Closure Cap"; U.S. Pat. No. 4,967,941 issued Nov. 6, 1990 entitled "Twist Lock Adjustable Metering Closure Cap." The disclosures of said two patents which illustrate structure and operational features of examples of twist top and pull/push closures hereby are incorporated herein by reference.

Attention also is directed to copending application Ser. No. 09/415,797, filed Oct. 11, 1999, entitled "Universal Base Pull/Push-Twist Closure", owned by the same assignee as the assignee of the present application, and disclosing a base similar to the base of the present invention. The disclosure of said copending application hereby is incorporated herein by reference.

The disclosure of U.S. Pat. No. 5,328,063 shows a pull/push closure in which a cap is mounted on its associated base and the closure is opened/closed by assertion of a pull/push force upon the cap with respect to the base. The disclosure of U.S. Pat. No. 4,967,941 shows a twist type closure in which the cap rides on a ramp formed in the associated base when the cap is twisted with respect to the base to effect the open/close operation of the cap with respect to the base. The disclosure of application Ser. No. 09/415,797 shows both pull/push and twist type closures which are movable to open/closed portions by either twisting or pull/push operation.

Interengagement between the aperture in the cap and the post formed on the base is intended to seal the closure and prevent product from being dispensed or escaping from the container on which the base is affixed. In instances where such closure are installed on liquid containers which retain a carbonated beverage product, such as carbonated water, it is desiralbe to incorporate a seal between the cap and the base which will prevent escape of the gas contained in such carbonated product for a maximum time period. Seal constructions of prior art closures have not been as successful as desired in preventing escape of carbonation gas from containers which retain such products so as to increase shelf life and to prevent such products from becoming stale. The seal construction of the present invention reduces the amount of torque required to open and close the closure. The seal construction also allows for greater interferences between the orifice in the cap and an interengaging plug on the base post which enables the sealing of greater pressure in the container which was not possible in prior art structures. Such greater interferences provide wider tolerance range to improve high volume manufacturing feasibility.

Additionally, it is desirable to provide an overcap component for such closures which protects the cap or spout from germ, dust and/or dirt contamination. Such an overcap also can provide a tamper-evident feature for such closures. An example of such an overcap is shown in U.S. Pat. No. 5,829,611 issued Nov. 3, 1998 entitled "Tamper-Evident Overcap," owned by a wholly-owned subsidiary of the Assignee of the present application. The disclosure of said patent hereby is incorporated herein by reference. In instances where such an overcap is used with a closure for a container retaining a carbonated beverage, the overcap serves an additional function of preventing carbonated liquid from spraying the user upon initial opening of the container. Further, it is desirable to provide an overcap which is capable of moving the cap over which the overcap is positioned relative to the base without the necessity for the user to touch the spout with his fingers, as in prior art constructions. For this purpose, it is desirable to provide an overcap which conforms in shape to the cap which is positioned under the overcap so as to facilitate movement of the cap to its open position upon movement of the overcap.

SUMMARY OF THE INVENTION

The invention is characterized by a closure including a cap movable with respect to its associated base between a closed sealed position and an open unsealed position in which product can be dispensed from a container upon which the base is secured. A generally U-shaped flange formed of resilient material such as plastic is positioned about the peripheral opening of an aperture formed in the cap which moves adjacent to a plug formed on the upstanding post of the associated base of the closure. One end of the U-shaped flange is secured to the aperture opening and the other end forms a terminal free end. The flange is in interference engagement with the plug when the cap is moved to its closed position. When so engaged, the terminal free end of the flange is moved into compression engagement with the wall of the plug. Also, the entire flange is moved to be spaced a greater circumferential distance about the plug than when the cap was in open or unsealed disposition with respect to the plug. Such spacing of the resilient flange adds or contributes to the sealing pressure of the flange about the plug.

The invention also is characterized, alternately, by a removable overcap positioned upon said base and disposed over the cap. The overcap preferably has an interior configuration which conforms to the exterior configuration of the cap to facilitate movement of the cap to open unsealed position without touching of the cap when the overcap is moved.

Various objects and advantages of the invention will become apparent in accordance with the above and ensuing disclosure in which the preferred embodiments are described in detail in the specification and illustrated in the accompanying drawings. It is contemplated that minor variations may occur to persons skilled in the art without departing from the scope or sacrificing any of the advantages of the invention.

DESCRIPTION OF THE PREFERRED EMBODIMENTS

Figure 1:
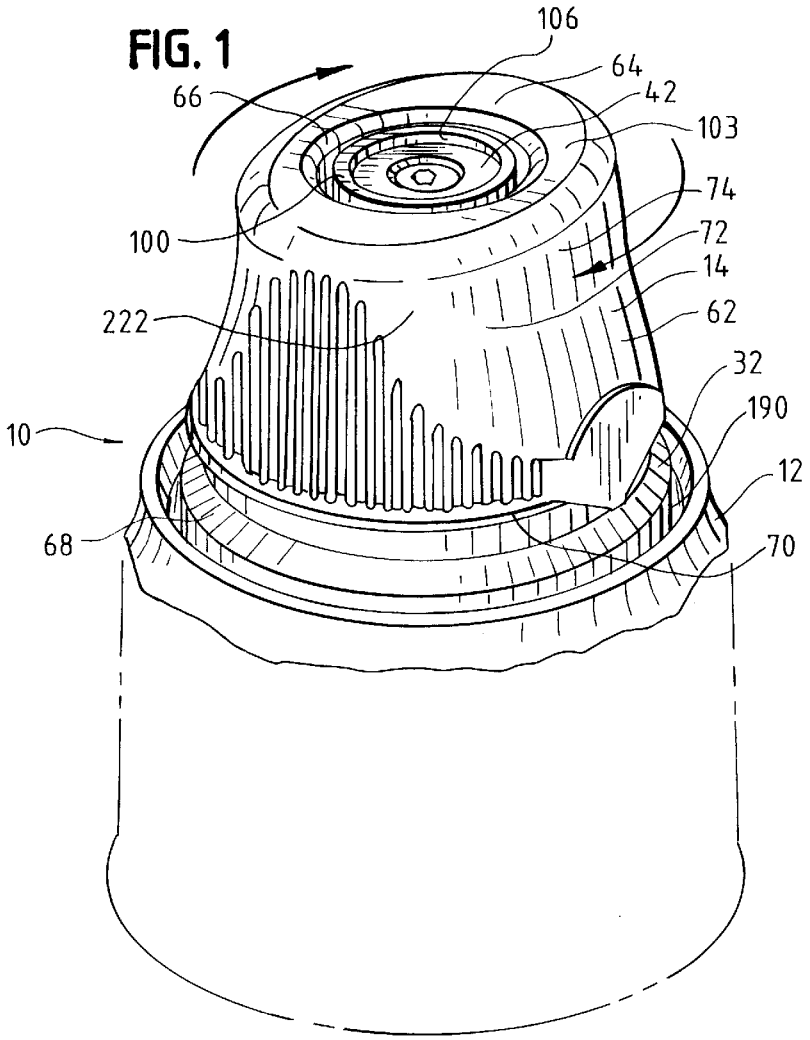
FIG. 1 is a perspective view showing the closure of the invention with the cap illustrated in closed position with respect to its associated base.

Referring to FIGS. 1–11, the closure 10, preferably formed of an appropriate food-compatible plastic material, comprises base 12 and spout or cap 14. The preferred form of closure 10 is illustrated as a twist top closure, but other closures, such as pull/push closures, may function within the intended scope of the invention.

The base 12 is adapted for attachment to a container top (not shown) in known manner, such as by screw threads 18 formed on the inner surface of the cylindrical side wall 20 of the base which mate with like threads on a container neck. The base also includes a top panel 22 extending inwardly from the base side wall 20. A vertically elongate post 24, integrally molded with the top panel 22, extends vertically therefrom coaxial with and inwardly spaced from the surrounding wall 20. The post 24 has a cylindrical side wall 26 defining a product flow passage 28 vertically therethrough and opening through the top panel 22. The post 24, having a radial dimension less than that of base side wall 20, forms a concentric channel 30 about the post and between the post wall 26 and a flange 32 defined from the upper portion of the base side wall 20 peripherally thereabout and extending upwardly from the base top panel 22. The external surface of the post wall 26 includes a lower portion 34 and an upper portion 36 with an annular abutment surface or shoulder 38 formed therebetween.

An annular sealing rib 40 is formed proximate to the upper terminal end of the upper portion 36 of the post 24 and extends circumferentially about the external surface of the post. A sealing plug 42 is centrally positioned within the upper terminal end portion of the post 24 and projects vertically therefrom in radially inwardly spaced relation to the post wall. The plug is supported by a support spider formed of spaced radially extending spokes 44 (see FIG. 5) which minimally restrict the flow of discharging product annularly about the plug 42 when cap 14 is in its open position, as will be described subsequently. The lower portion 34 of the post wall is formed with a pair of diametrically opposed helical groove channels 46.

Twist cap 14 is formed with an upstanding wall 62 having a top platform 64 with aperture 66 therethrough extending between upper surface 103 and lower surface 105 of platform 64, and a lower terminal end 68 with circumferentially projecting flange 70 formed proximate thereto. The external surface 72 of cap 14 preferably is of generally oval or elliptical configuration with relatively flat side walls 74, 76 to facilitate grasping of the cap by a user to effect a twist motion thereto.

The inner surface 78 of cap 14 is adapted for cooperative engagement upon post 24 of base 12, and is formed with a pair of oppositely disposed, radially inwardly projecting drive threads 79, 80. Respective drive threads 79, 80 are equally spaced around the cap circumference from each other, and are matingly engageable within respective helical grooved channels 46 formed on post 24. Twisting of cap 14 causes threads 79, 80 to ride in channels 46 and thereby draw the cap downwardly upon post 24 to the closed position of cap 14 shown in FIGS. 1, 4 and 9. In said closed position, sealing plug 42 of post 24 engages within aperture 66 to seal the aperture and prevent dispensing of product therethrough.

Figure 2:
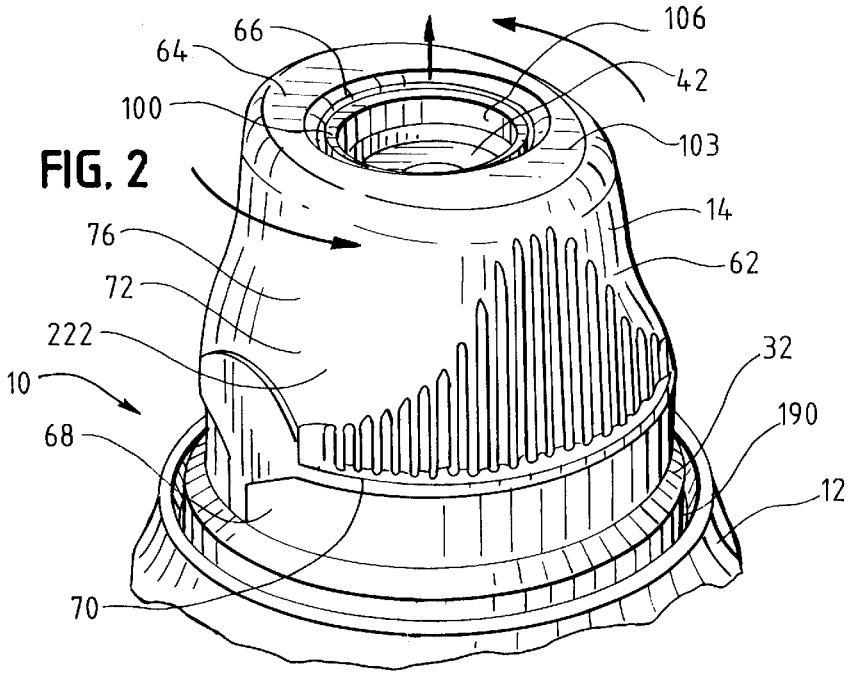
FIG. 2 is a perspective view similar to that of FIG. 1 but illustrating the cap moved to its open position.
Figure 3:
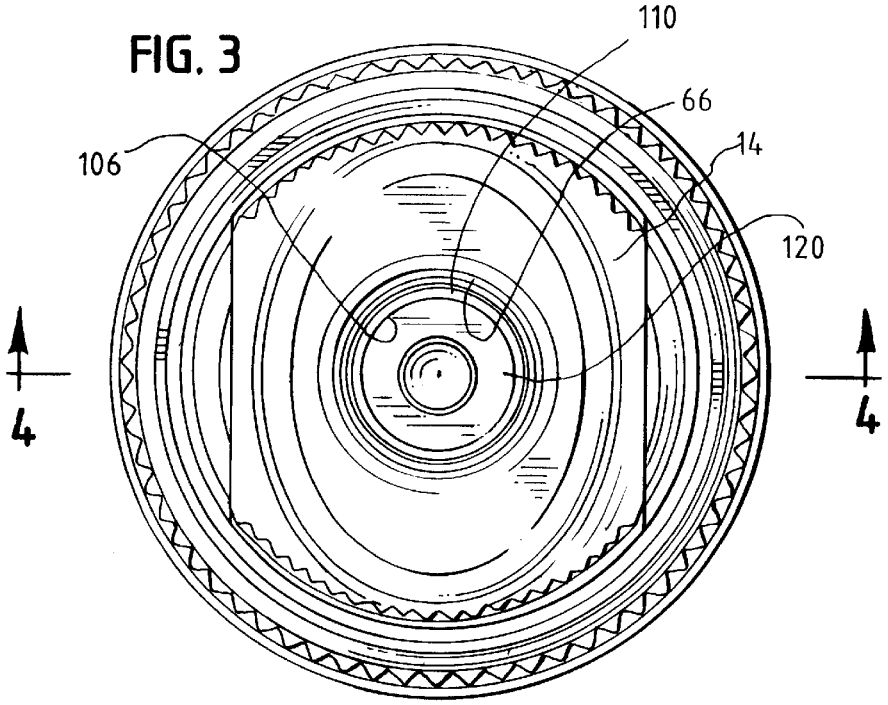
FIG. 3 is a top plan view of the closure of the invention.
Figure 4:
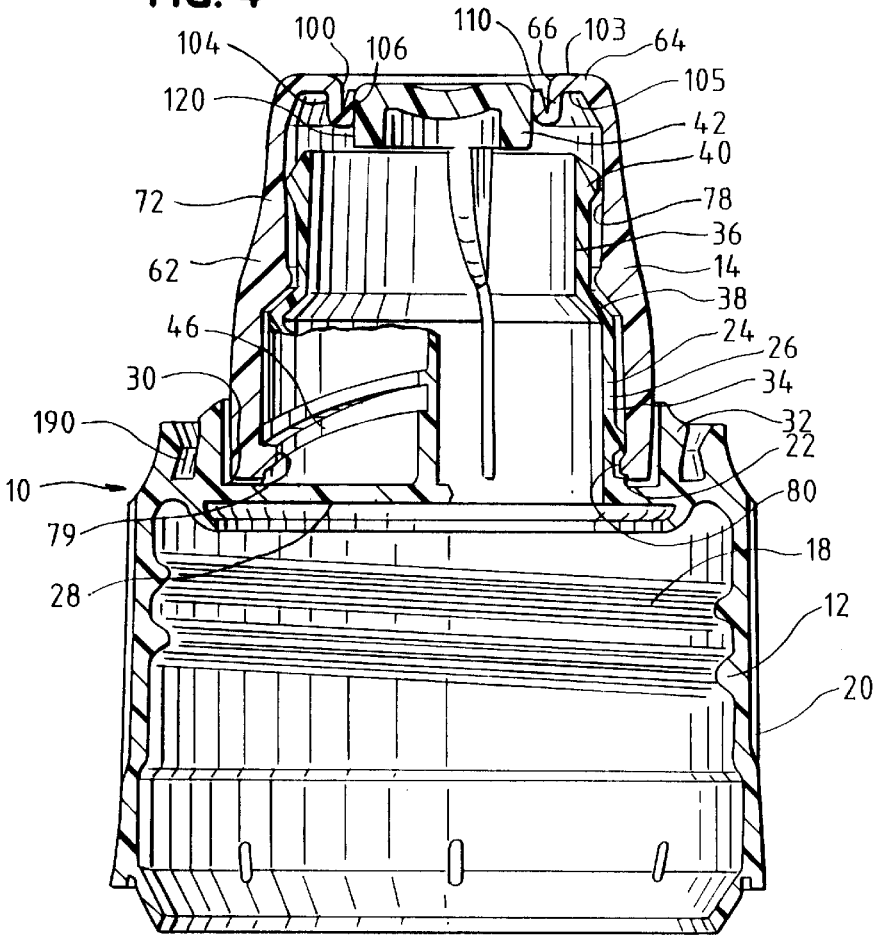
FIG. 4 is a sectional view taken along the line 4—4 in FIG. 3, in the direction indicated generally.
Figure 5:
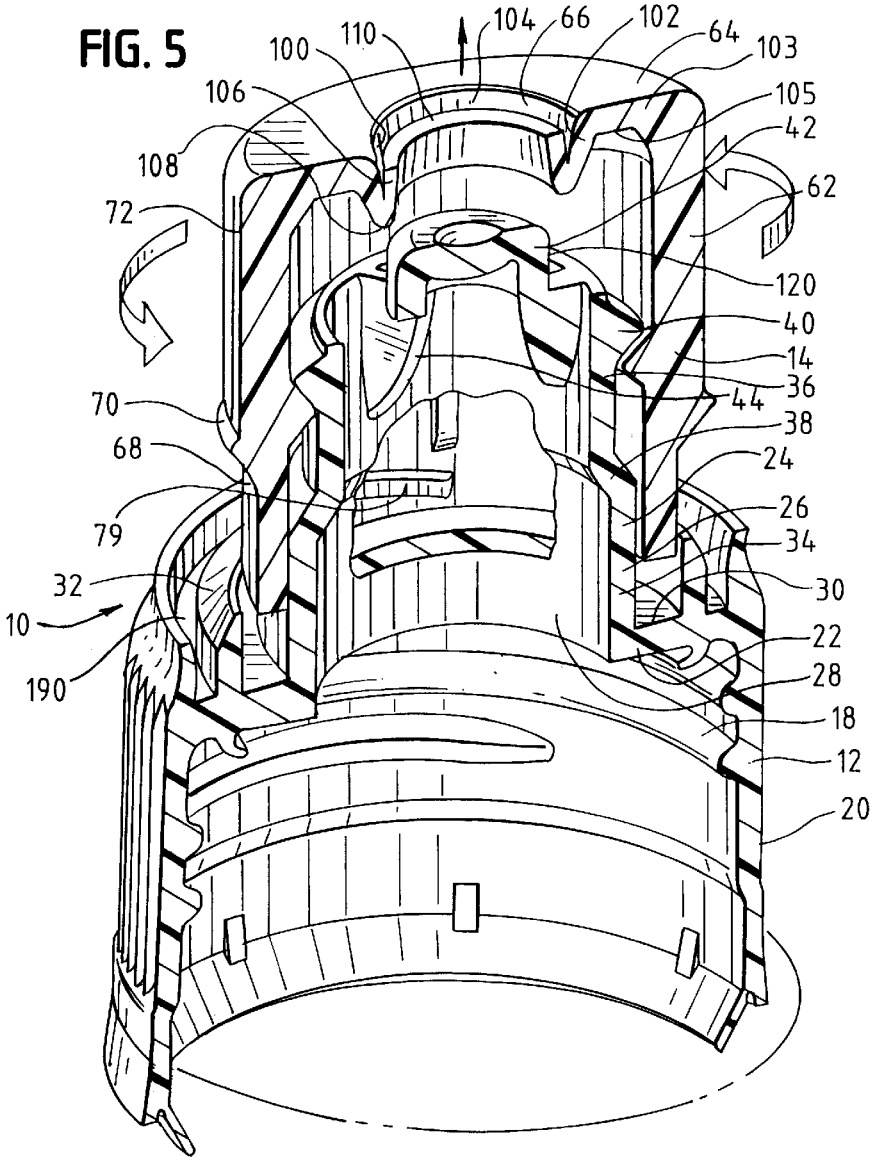
FIG. 5 is a perspective longitudinal sectional view of the closure with the cap illustrated in its open position.
Figure 6:
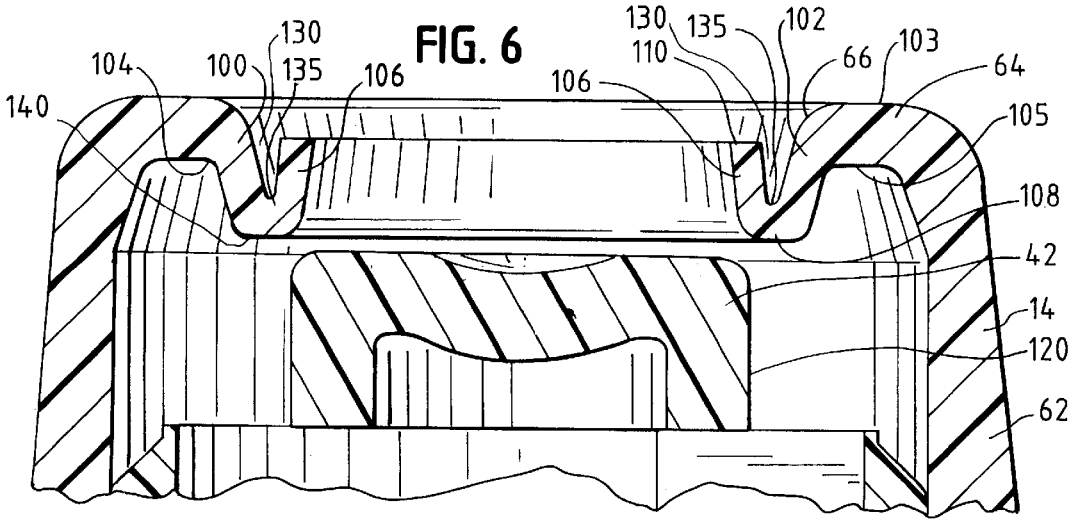
FIG. 6 is an enlarged fragmentary sectional view of the upper portion of the cap when disposed in its fully open position.

Opening of twist cap 14 is accomplished by counter-turning same on base 12 thereby causing threads 79, 80 to reverse-ride in channels 46 and move the cap upwardly on post 24 to the opened position shown in FIGS. 2, 5 and 6. When cap 14 is moved to its opened position, plug 42 is withdrawn from engagement with aperture 66, and product thereby may be dispensed from the container through the passageway 28 in base 12 and out aperture 66 in cap 14.

Annular sealing flange 100 is formed on aperture 66 in order to enhance the sealing characteristics between plug 42 and its engagement within aperture 66 when cap 14 is moved to its closed position. Flange 100 is of generally U-shaped configuration and includes a first leg portion 102 which is formed integral with and extends downwardly from the circumferential periphery 104 of aperture 66 and below the lower surface 105 of top platform 64 of cap 14. A second leg portion 106 is connected to first leg portion 102 at a connecting portion 108 and is reverse-bent with respect to first leg portion 102 and terminates at free end 110. A crease 135 is formed above connecting portion 108 between legs 102 and 106.

As best seen in FIGS. 6–9, the dimensional proportions of aperture 66 and sealing flange 100 are such that, prior to engagement of flange 100 with plug 42 (FIGS. 6 and 7), leg 106 interferes with the external surface 120 of plug 42. When cap 14 is moved toward its closed position upon base 12 (FIGS. 7 and 8), leg 106 is moved into interference engagement with surface 120 and is forced radially away from surface 120 (see arrow F1 in FIG. 8), but is maintained in compression engagement therewith by reason of the resilient nature of the plastic material from which closure 10 is formed. Simultaneously, leg 102 also is forced radially away from surface 120 (see arrow F2 in FIG. 8), such that both legs 102 and 106 maintain compression engagement against surface 120.

Figure 7:
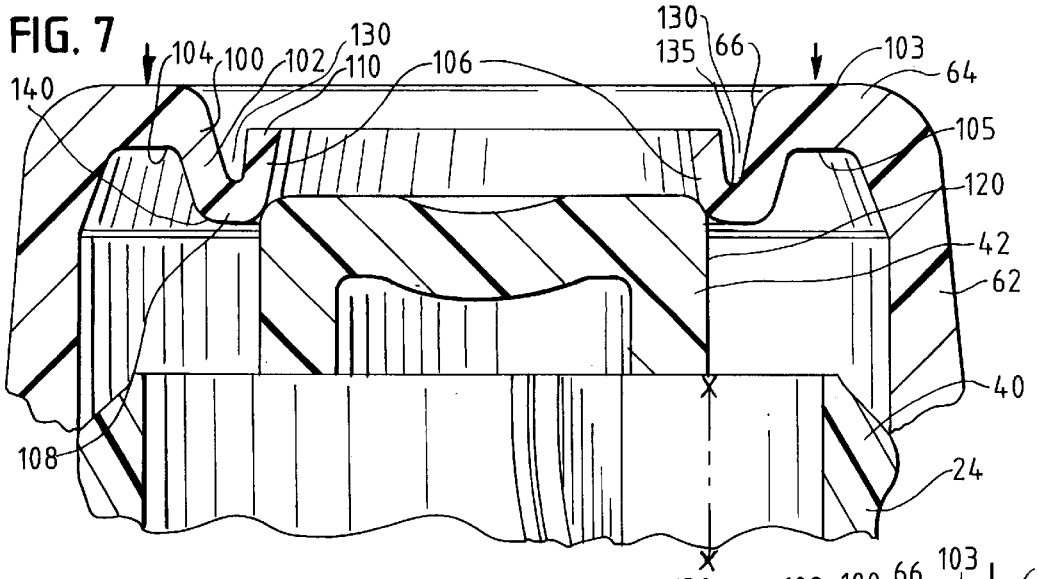
FIG. 7 is an enlarged fragmentary view similar to that of FIG. 6, but showing the cap moved toward its closed position.
Figure 8:
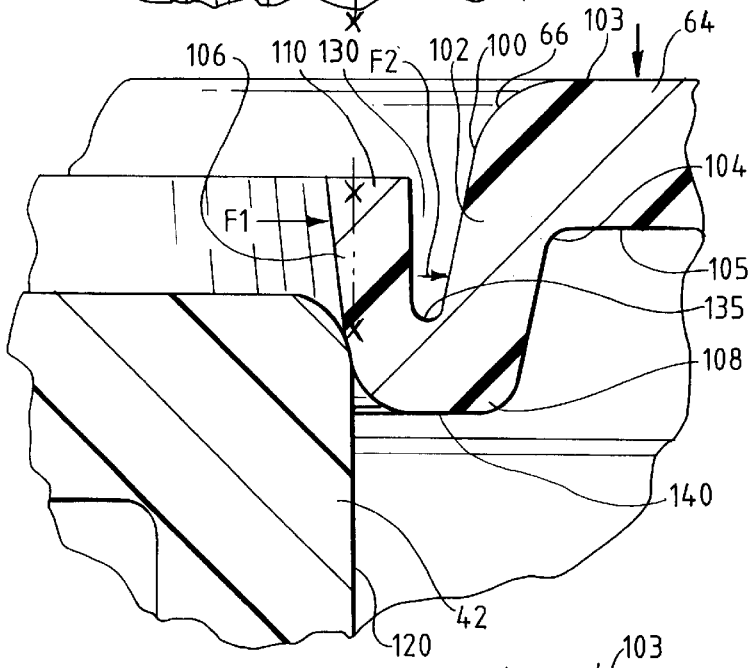
FIG. 8 is an enlarged fragmentary sectional view similar to that of FIGS. 6 and 7,but showing the cap moved to a partially closed position.

When cap 14 is moved to its completely closed position on base 12 (FIG. 9), leg 106 is in full engagement with surface 120 and complete compression is achieved between the sealing flange 100 and the plug 42. Also, the leg 102 is moved to be spaced a greater circumferential distance about plug 42 than when cap 14 was in its open or unsealed position (FIGS. 6 and 7) with respect to the plug. Such spacing of the resilient flange 100 adds to or contributes to the sealing pressure of the flange about the plug. A projection line X—X between FIGS. 7, 8 and 9 shows the relative movement of legs 102, 106 with respect to surface 120 of plug 42 as the cap 14 is moved from its open to closed position.

Figure 9:
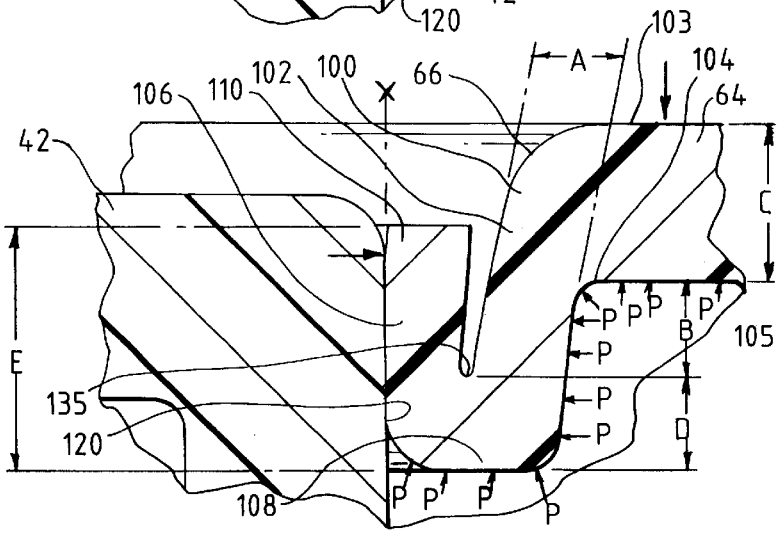
FIG. 9 is an enlarged fragmentary sectional view similar to that of FIGS. 6–8, but showing the cap moved to its fully closed position.
Figure 10:
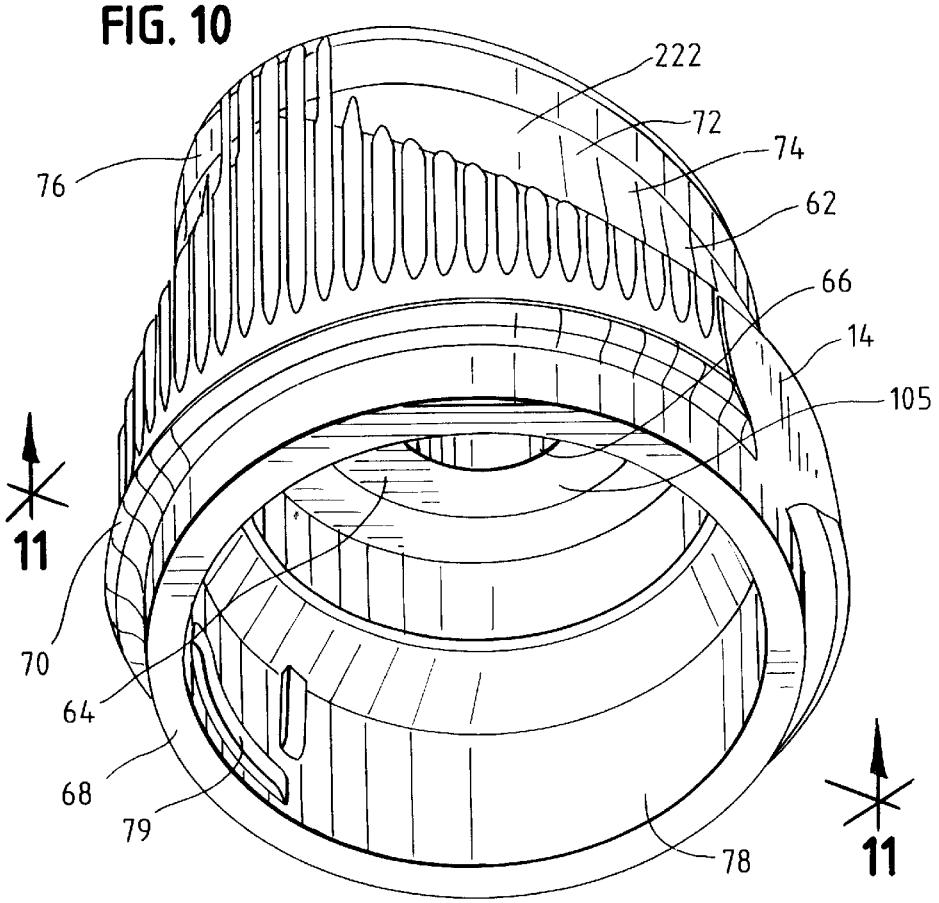
FIG. 10 is a bottom perspective view of the cap of the invention.
Figure 11:
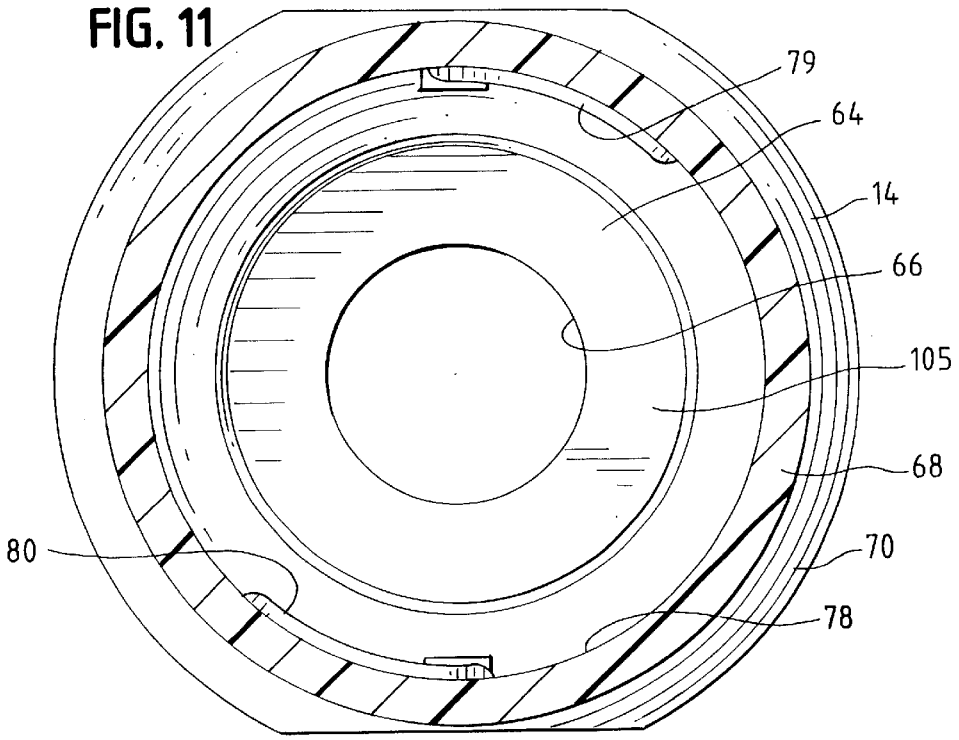
FIG. 11 is a bottom plan view of the cap of the invention.

When cap 14 is moved to its fully closed position shown in FIG. 9, the seal flange 100 conforms to surface 120 of plug 42 to maintain contact therebetween. Arrows P indicate the forces of the contents of the container upon which closure 10 is positioned to maintain constant sealing pressure against flange 100. As the sealing pressure of the container contents increases, the sealing forces P increase. The external channel above crease 135 between legs 102 and 106 is exposed to atmosphere which permits the legs 102, 106 to conform to surface 120 with minimized effect from the pressure of the contents of the container. The pressure forces are transmitted through connecting portion 108 to contribute to the forces from the container contents which reinforce leg 106 and maintain the seal as pressures increase.

Optimal performance of pressure seal 100 is achieved when the proportional dimensions of legs 102 and 106 are as follows (see FIG. 9):

Thickness A of leg 102 is less than or equal to the distance B between lower surface 105 of cap platform 64 and crease 135 proximate connecting portion 108 between legs 102 and 106.

Thickness A of leg 102 is less than the thickness C of platform 64 between upper surface 103 and lower surface 105.

The length E of leg 106 between free end 110 and the lower surface 140 of connecting portion 108 is more than the combined dimension B and D, where D is the distance between crease 135 and lower surface 140 of connecting portion 108.

The distance D is less than or equal to the thickness A.

In tests over an extended time period of the closure 10 of the invention having sealing flange 100 in comparison to prior art closures which do not include such a sealing flange, the prior art closures maintained a 20 psi pressure in only 60% of the samples; closures of the invention including the sealing flange 100 maintained such pressure in 97% of the samples, thus demonstrating a substantially improved seal. Prior art closures performed at a 15% success rate holding at or above 10 psi; closures of the invention successfully hold 15 psi or above at a success rate of 89%. Based upon these tests, the closure of the invention with sealing flange 100 averaged a six-fold performance advantage over the prior art closures.

An additional and alternate feature of the invention is illustrated in FIGS. 12–16 of the drawings. The same closure 10 shown in FIGS. 1–11 is shown in FIGS. 12–16, and therefore, identical reference numbers are used to identify the same parts with reference thereto. FIGS. 12–16 illustrate closure 10 with overcap 200 illustrated in association therewith. Although overcap 200 is shown in association with closure 10, it is to be understood that the overcap can be used with other types of closures within the contemplation of the present invention.

Base 12 is provided with circumferential channel 190 disposed concentrically with respect to channel 30 and spaced radially outwardly with respect thereto.

Overcap 200 includes a domed top portion 210 having a lower edge 212 connected by frangible connections 214 to circumferential skirt 216 which is permanently retained by the force-fit within channel 190. The interior surface configuration 220 of domed portion 210 is chosen to be substantially conforming to the exterior surface configuration 222 of closure 10. In the preferred embodiment illustrated, this configuration is generally oval or elliptical at the extreme upper end 224 thereof and also in the transitional area 226 above a generally cylindrical lower portion 228. Although a specific generally elliptical configuration is shown in the drawings, it is to be understood that other configurations are within the scope and contemplation of the invention.

Figure 13:
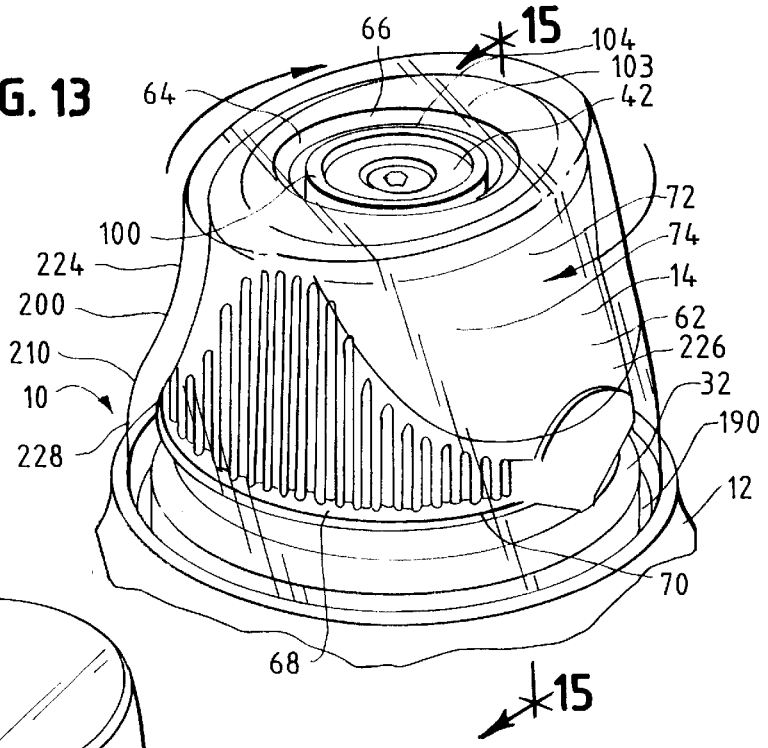
FIG. 13 is a perspective view illustrating the closure of the invention with the overcap of FIG. 12 shown installed over the cap, the cap being shown in closed position with respect to its associated base.
Figure 12:
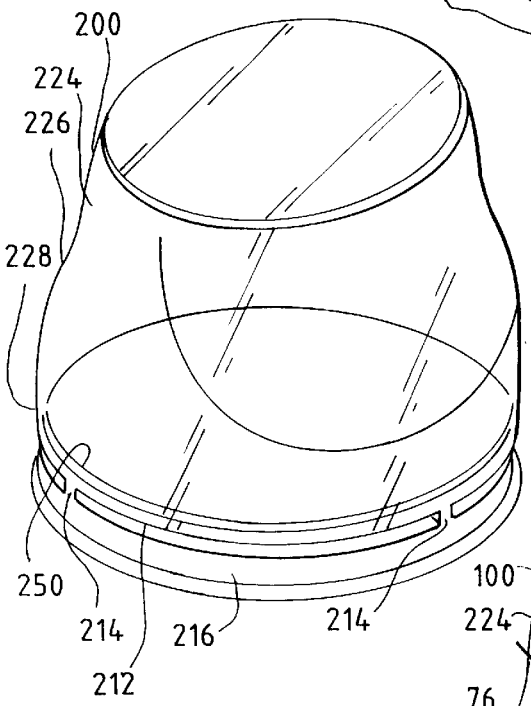
FIG. 12 is a perspective view of the overcap of the invention.
Figure 14:
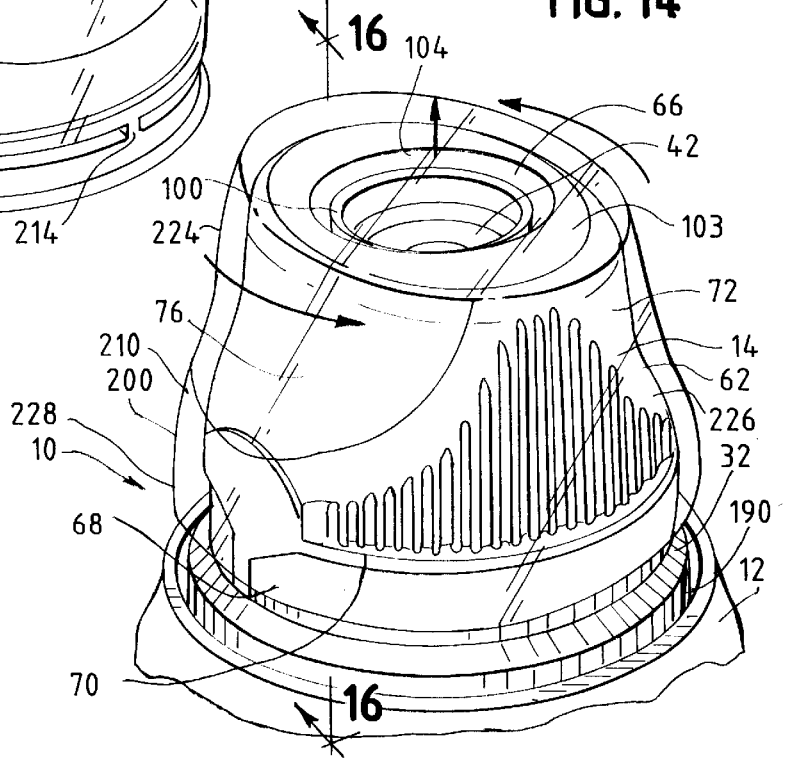
FIG. 14 is a perspective view similar to that of FIG. 13, but illustrating the cap and overcap moved to the open position of the cap.
Figure 15:
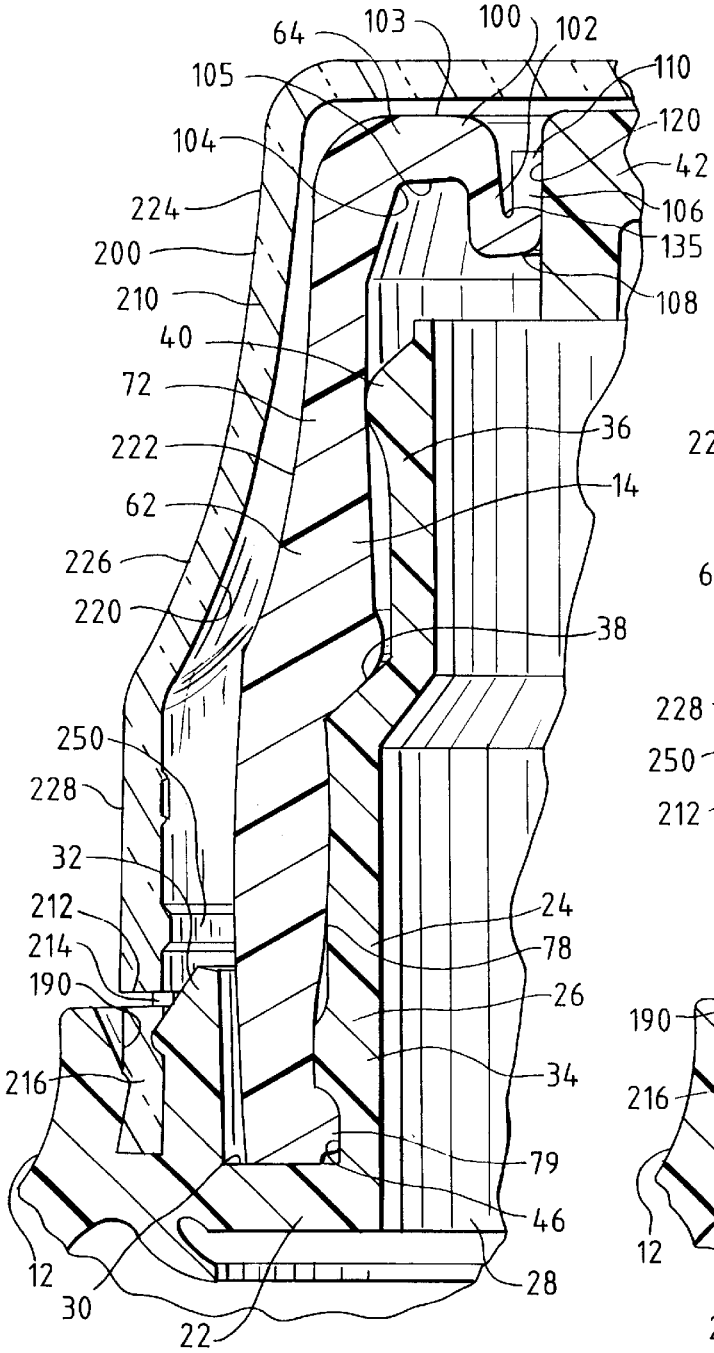
FIG. 15 is a sectional view taken along the line 15—15 of FIG. 13, in the direction indicated generally.
Figure 16:
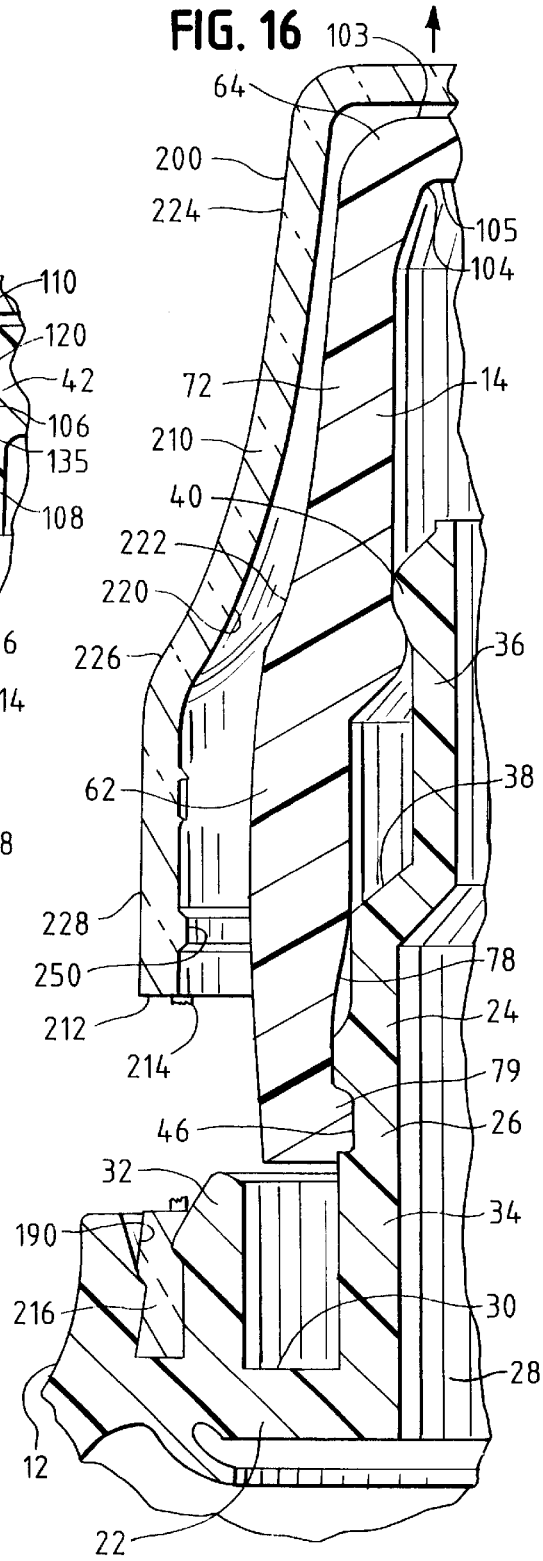
FIG. 16 is a sectional view taken along the line 16—16 of FIG. 14, in the direction indicated generally.

When overcap 200 is installed upon closure 10, the closure is in its closed position illustrated in FIGS. 13 and 15. When it is desired to move cap 14 to its open position with respect to base 12, a twisting force is asserted on the overcap external surface. By reason of the conforming interior surface configuration 220 of over cap 200 to the exterior surface configuration 222 of cap 14, twisting of the overcap results also in twisting of cap 14. Upon such twisting movement, frangible connections 214 are severed and the overcap moves the cap 14 upwardly to its open position shown in FIGS. 14 and 16. Reverse operation can be effected to move the cap to its closed position.

The overcap 200 can be formed of opaque, translucent or transparent material, the latter being illustrated in the drawings. The illustrated construction is such that the closure can be opened without touching the cap. Also, the overcap redirects any leakage or spray from the container on which the closure is positioned so as to minimize contact by the container contents to the user.

Other configurations and variations in the structure, arrangement and size of the various parts may occur to those skilled in the art without department from the spirit or circumventing the scope of the invention as set forth in the appended claims. For example, the overcap may be provided with an interior projecting flange 250 to engage under the exterior projecting flange 70 formed on the cap (see FIGS. 13 and 14) to retain the overcap on the closure after the overcap has been initially opened and thereby to prevent same from inadvertently falling off the closure when it is re-positioned after initial opening.

What is claimed is:

1. A container closure comprising, a base adapted to be secured to a mouth of the container for controlled dispensing of a product from the container, the base including a top panel and a side wall depending peripherally from said top panel, a central post projecting axially upward from said top panel centrally thereof in radially inwardly spaced relation to said side wall, said post defining a product flow passage vertically therethrough and opening through said top panel, said product flow passage having an open upper end vertically remote from said top panel, a sealing plug centrally positioned relative to said product flow passage at said upper end and arranged to allow for product movement past said plug, means for mounting said plug to said product flow passage with minimal restriction of the passage outward of the plug, a cap including a peripheral wall received over said post, said cap having a top platform closing off said peripheral wall, a central aperture formed in said top platform and aligned with said plug, said cap being telescopically adjustable on said post between a lower closed position with said plug engaged in said aperture and an upper open position with said plug spaced below said aperture to allow product discharge through said aperture, an annular generally U-shaped sealing flange formed on said aperture, said flange including a first leg and a second leg formed integral with each other, said legs extending substantially below the circumferential periphery of the aperture and below the top platform of the cap.

2. A container closure as claimed in claim 1 in which said first leg is formed integral with the circumferential periphery of said aperture, said second leg being connected to said first leg by a connecting portion, said second leg terminating at a free end.

3. A container closure as claimed in claim 1 including an overcap positioned over said cap, said overcap having in internal configuration substantially conforming in cross-sectional dimensions to the external configuration of said cap.

4. A container closure as claimed in claim 2 in which a crease is formed proximate to said connecting portion between said first and second legs.

5. A container closure as claimed in claim 3 in which the top platform of said cap is of generally non-circular cross-sectional configuration.

6. A container closure as claimed in claim 4 in which the plug has an external surface which is engaged by said second leg in interference fit when said cap is moved to its lower closed position.

7. A container closure as claimed in claim 3 in which said base includes a circumferential channel disposed on said top panel concentrically with respect to said side wall, said overcap including a domed top portion having a lower edge and a circumferential skirt connected to said lower edge, said lower edge being retained in said circumferential channel, the cross-section configuration of said cap and said overcap being generally elliptical at their respective extreme upper ends and being generally cylindrical at their respective lower ends.

8. A container closure as claimed in claim 6 in which the first leg is forced radially away from said external surface of the plug when said cap is moved to its lower closed position.

9. A container closure as claimed in claim 7 in which rotational movement of said overcap imparts rotational movement to said cap.

10. A container closure as claimed in claim 8 in which the second leg is in full engagement with said external surface of the plug when said cap is moved to its lower closed position.

11. A container closure as claimed in claim 10 in which the top platform has an upper surface and a lower surface, said legs extending below said lower surface.

12. A container closure as claimed in claim 11 in which the thickness of the first leg is less than or equal to the distance between said lower surface and said crease.

13. A container closure as claimed in claim 12 in which the thickness of the first leg is less than the thickness of the platform between said upper surface and said lower surface.

14. A container closure as claimed in claim 13 in which said connecting portion has a lower surface, the length of said second leg between said free end and the lower surface of said connecting portion is more than the combined distance between the lower surface of said platform and the distance between said crease and the lower surface of the connecting portion.

15. A container closure as claimed in claim 14 in which the distance between said crease and the lower surface of said connecting portion is less than or equal to the thickness of said first leg.

16. A container closure comprising, a base adapted to be secured to a mouth of a container for dispensing of a product from the container, a cap positioned on said base and moveable telescopically thereon between an open and a closed position with respect to the base, an overcap positioned over the cap, the overcap having an internal configuration substantially conforming in cross-sectional dimensions to the external configuration of the cap and wherein said base has a top panel and a side wall depending peripherally from said top panel, a circumferential channel disposed on said top panel concentrically with respect to said side wall, said overcap including a domed top portion having a lower edge and a circumferential skirt connected to said lower edge, said lower edge being retained in said circumferential channel, the cross-sectional configuration of said cap and said overcap being generally non-circular at their respective extreme upper ends and being generally cylindrical at their respective lower ends.

17. A container closure as claimed in claim 16 in which the cross-sectional configuration of the cap and overcap at their extreme upper ends is generally elliptical.

18. A container closure as claimed in claim 16 in which rotational movement of said overcap impacts rotational movement to said cap.

* * * * *